United States Patent [19]

Rudd et al.

[11] Patent Number: 4,734,329

[45] Date of Patent: Mar. 29, 1988

[54] SHOCK ABSORBING MISSILE LAUNCH PAD

[75] Inventors: George E. Rudd, Murrysville; Joseph F. Meier, Export; John T. Siemon, Plum Borough; James O. Bowden, Trafford, all of Pa.; David F. Weir, San Ramon, Calif.

[73] Assignee: The United States of America as represented by the Secretary of the Air Force, Washington, D.C.

[21] Appl. No.: 614,905

[22] Filed: May 29, 1984

[51] Int. Cl.[4] ..... B32B 27/00; D02G 3/00

[52] U.S. Cl. ..... 428/383; 428/390; 428/391; 89/1.816

[58] Field of Search ..... 428/390, 391, 383; 89/1.816

[56] References Cited

U.S. PATENT DOCUMENTS

| | | | |
|---|---|---|---|
| 3,089,388 | 5/1963 | Webster et al. | 89/1.7 |
| 3,124,040 | 3/1964 | Fiedler | 89/1.7 |
| 3,166,978 | 1/1965 | Price et al. | 89/1.7 |
| 4,051,298 | 9/1977 | Mişiura et al. | 428/383 |
| 4,303,574 | 12/1981 | Vostovich | 260/42.15 |
| 4,336,740 | 6/1982 | Leigh et al. | 89/1.816 |
| 4,357,855 | 11/1982 | Merz | 89/1.816 |
| 4,419,475 | 12/1983 | Vostovich | 524/264 |

*Primary Examiner*—John E. Kittle
*Assistant Examiner*—Patrick J. Ryan
*Attorney, Agent, or Firm*—Jacob N. Erlich; James E. Maslow; Donald J. Singer

[57] ABSTRACT

Shock absorbing missile launch pad for Mx type missiles having molded ethylene propylene diene terpolymer composition. Pad has curved resilient rubber pad with a Teflon-fiberglass laminate bonded to outer convex surface thereof, and has a support plate bonded to the inner concave surface thereof. Springs are provided to urge pad away from missile at launch to prevent damage to missile.

11 Claims, 26 Drawing Figures

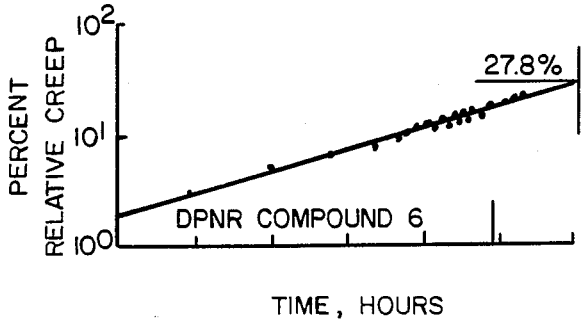
FIG. 2 a
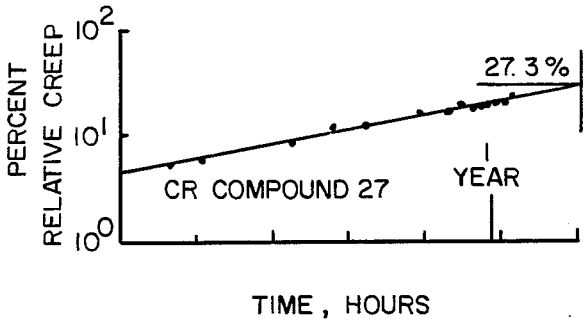
FIG. 2 b
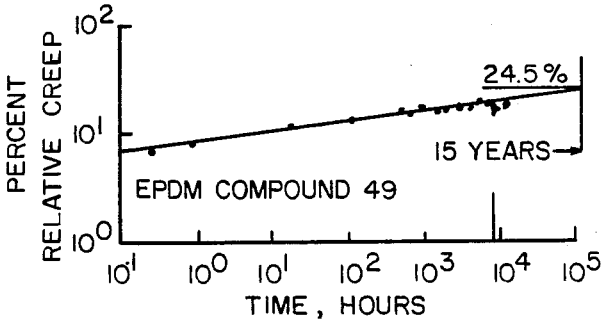
FIG. 2 c
FIG. 3
PRIOR ART
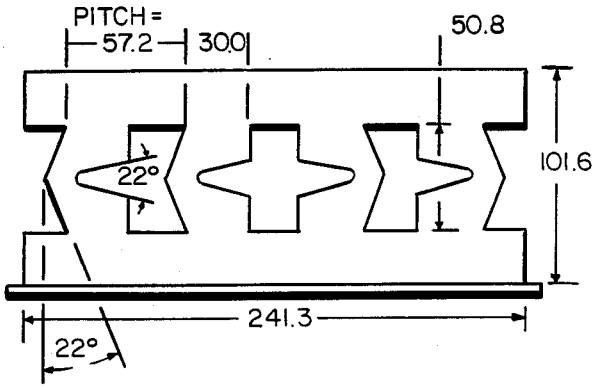

FIG. 5
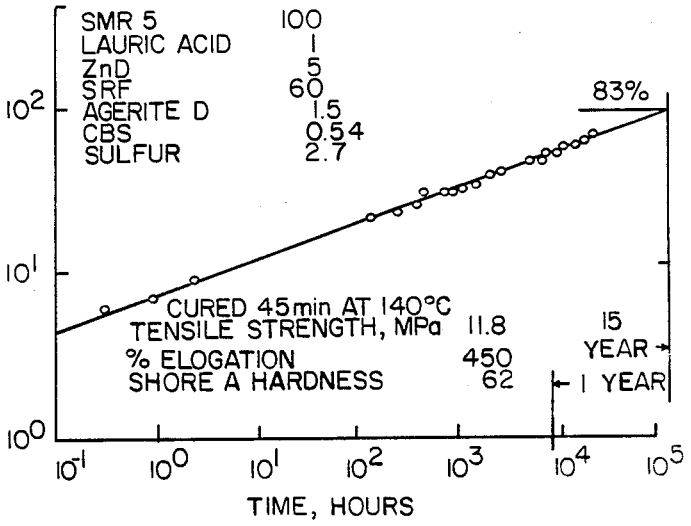
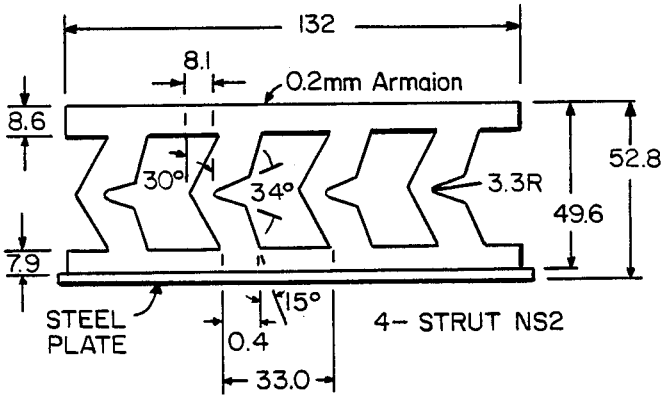
FIG. 6a
PRIOR ART
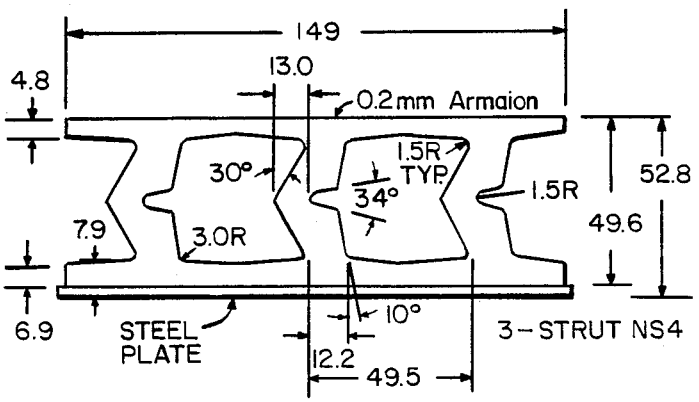
FIG. 6b
PRIOR ART 5B-1

LOG % RELATIVE CREEP
25.1% AT 10 YEARS
TIME, LOG HOURS 5B-2

LOG % RELATIVE CREEP
26.4% AT 10 YEARS
TIME, LOG HOURS 5B-3

LOG % RELATIVE CREEP
26.3% AT 10 YEARS
TIME, LOG HOURS 5B-4

LOG % RELATIVE CREEP
23.5% AT 10 YEARS
TIME, LOG HOURS

SHOCK ABSORBING MISSILE LAUNCH PAD

STATEMENT OF GOVERNMENT INTEREST

The invention described herein may be manufactured and used by or for the Government for governmental purposes without the payment of any royalty thereon.

BACKGROUND OF THE INVENTION

The present invention relates to missile launchers and more particulary to shock absorbing missile launch pads for use in isolation of MX-type missiles from various environmental interference.

It is known in the art to provide means for protecting a missile from vibrations applied to the mounting structure upon which the missile is adapted. One such device is disclosed in U.S. Pat. No. 4,357,855, in which a liner for lining the interior surface of a canister which carries and supports the launching of a missile includes a first resilient layer, a second thermally reflective layer, and a third layer having a low coefficient of friction. The first layer contacts the inner surface of the canister, the second layer is interposed between the first and third layer, and the third layer contacts the outer surface of the missile. More particulary, the first layer is a resilient layer of supple material, such as rubber. The second layer is reflective and is comprised of a thin foil-type material. The third layer provides low coefficient of friction interaction with the missile outer surface. This third layer is transparent to heat. The second layer reflects heat transmitted through the third layer, such that the device is reusable.

In U.S. Pat. No. 3,124,040, a rubber mat with spaced annular fins is disclosed coated with Teflon or Nylon, and is formed into a tubular sleeve with the fins projecting toward the sleeve's center. It is placed in a missile tube and therein forms a buffer or support system for a missile to be carried within the tube.

One problem with the above prior art, and similiar art, is that these pads fail to reflect the requirements of MX type missile systems. Most notably, the force versus deflection characteristics and mechanical creep requirements of such pads are different in that prior art missiles have contemplated vertical storage. In a MX land based type arrangement such missile is stowed horizontally and is raised to a near-vertical position at launch. Furthermore, the MX environmental specifications also require that the pads have better ozone resistance than in prior art pads.

The creep characteristics of an elastomeric canister-to-missile support pad are influenced by stress history, temperature, base elastomer, filler content, crosslink density, type of crosslink, carbon black, pre-stressing and moisture. Ozone has a significant deleterious effect on some elastomers, such as natural rubber, but this effect may be minimized by application of antidegradants or the like. The present invention was developed in view of these influences.

SUMMARY OF THE INVENTION

Based upon the foregoing, it is an object of the present invention to provide a maximally creep resistant missile support pad having improved force deflection characteristics for use in MX type missile systems.

In accordance with the teachings of the present invention, a shock absorbing molded ethylene propylene diene terpolymer (EPDM) missile launch pad is disclosed comprising a curved resilient rubber pad with a Teflon-fiberglass laminate bonded to the outer convex surface thereof, and having a reinforced plate bonded to the inner concave surface thereof. The Teflon surface provides a low friction slip surface to slide against the missile canister and the fiberglass reinforced plastic plate is positioned toward the missile outer skin. The pad defines a plurality of longitudinal and latitudinal cavities therein and is configured to desired force-deflection characteristics.

DESCRIPTION OF THE DRAWINGS

The present invention will be more clearly understood with reference to the following detailed description in conjunction with the accompaning drawings, in which:

FIG. 2 (*a–c*) is a graphical representation of tensile creep performance of several prior art candidate elastomer formulations;

FIG. 3 is a side representational view of a prior art tapered notch strut mold and dimensions thereof;

FIG. 5 is a graphical representation of compressive creep characteristics of two-strut NR pad HAS-6-84-2 loaded at 0.14 MPa;

FIG. 6 (*a–b*) is a cross-sectional view of two prior art pad designs used with EPDM compound 49, with dimensions shown in millimeters;

DETAILED DESCRIPTION

Figure 1A:
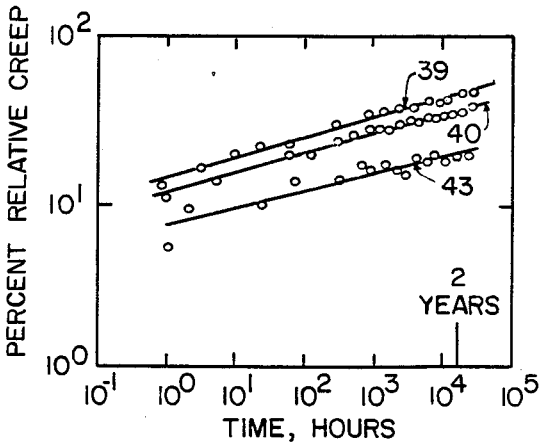
FIG. 1 (*a–d*) is a graphical representation of tensile creep results for EPDM compounds 39, 40, 43, 44, 46, 49, 50, 57, 58, 61 and 73.
Figure 1B:
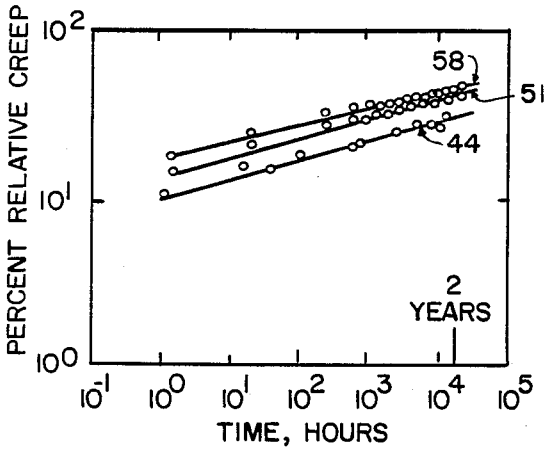
Figure 1C:
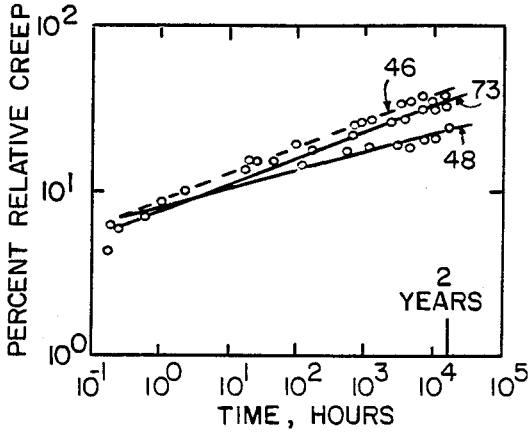
Figure 1D:
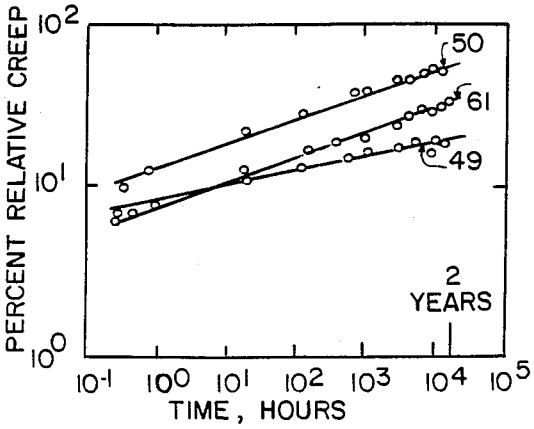

In the past, various elastomer formulations have been tested regarding meeting a 60% relative creep requirement for 15 years exposure in an atmosphere containing 25 parts per hundred million (pphm) $O_3$ by Volume at 25°–30° C. These parameters were also employed in evaluating the present invention. The following paragraphs identify prior art test results, while defining acceptable creep test procedures and discussing extrapolation techniques from three-year creep data, as essential background to understanding the present invention. These prior art results are extracted from *Rubber Chem-*

*istry and Technology,* Volume 52, No. 1, March–April 1979, at pp 50–73, in an article by J. F. Meier, G. E. Rudd, and D. F. Weir, entitled "Creep Resistant Elastomer Formulations".

As reported in the above article, before tensile creep testing is begun, a tensile test to failure is conducted to measure the overall short-term properties of the material at issue. The tensile specimen is diecut from an elastomer sheet 1.27 to 2.54 mm thick with an ASTM-D142 die "C". Tensile tests are conducted in an Instron machine at 8.5 mm/s with pneumatic grips. When the 25.4 mm specimen gage length has been elongated 20%, the recorder pen is "pipped". Extension continues until 200% elongation is achieved at which point the cross head is reversed and returned to the original position. Elongations are measured by a scale held adjacent to the specimen during the test. The stress at 20% strain is used later as a tensile creep load, and the short-term set exhibited after 200% extension is used as a measure of material hysteresis. After the 200% extension, the specimen is reloaded to failure.

Tensile creep tests are conducted by suspending a tensile specimen from a rack and loading the specimen with sufficient weight to impart a 20% initial strain. The weight is applied quickly but smoothly, and cathetometer readings taken at 1, 2, 3, 6 and 10 minutes and then every hour for the first day. Thereafter, measurements are taken daily, weekly and then monthly or bimonthly, depending on the characteristics of the individual specimen.

Creep results are presented as percent relative creep as found in MIL-HDBK 149A.

% Relative Creep
= total deformation - initial deformation/initial deformation X100
$= (L_t - L_0) - (L_1 - L_0) \times 100/(L_1 - L_0) = (L_t - L_1) \times 100/(L_1 - L_0)$, where $L_0$=original undeformed gage length, $L_1$=gage length after 1 minutes loading and $L_t$=gage length after time, t. Because the $L_1$ value is important in this definition in comparing materials, the length is plotted against log time for the initial approximately 60 minutes, and $L_1$ is calculated by least square. This technique has been used by others also. The actual length determined by the cathetometer and the length at one minute taken from the linear regression generally agree within 0.025 mm. If the discrepancy exceeds 0.127 mm, a new sample is loaded.

Because of the particular definition the relative creep can exceed 100%, even in compression.

Ambient temperature and relative humidity are recorded continuously near the creep test rack, and $O_3$ concentration is measured periodically.

The compression-deflection tests are run in a 89 kN Instron machine at 0.85 mm/s. The pad is compressed until the load is equivalent to 2.1 MPa pad stress and then immediately unloaded. The cycle is repeated three or four times without pause.

Pad compression creep tests are conducted in creep machines intended primarily for tensile creep testing. Dead weight/lever type machines are used with a simple fixture to permit loading in compression. Loading is accomplished by adding weights to a weight pan on the end of the lever. Deflection is noted by reading a machinist's dial gage fixed to the loading fixture.

Compressive or tensile creep is defined as the increase in deformation with time under constant stress. With elastomers, creep consists of two distinct processes, physical and chemical. Under normal conditions, both processes will occur simultaneously. Physical creep, which dominates at short times, is related to the displacement or slippage of rubber molecules past one another through the matrix. A second process, which has a much longer range than physical disentanglement or slippage of chains, is a chemical or oxidative process. Experimentally, these processes are manifested by an initial creep rate which is often linear on a long time basis and can be expressed as percent creep per decade of time. Creep then passes through a transition range as the effect of oxidation increases and finally becomes largely oxidative. The transition occurs at about $10^3$ to $10^4$ minutes on a semi-log plot for NR, for long-term applications chemical is probably the dominant mechanism, but the initial physical process is certainly significant. It was reported to have been found that a log creep-log time model best fits the test data and was concluded to be appropriate for long term data.

A commom design practice is to select a material for a given task and then adjust the geometry to accommodate the material selection. Also common is to fix a geometry and then select a suitable material. However, in the reported project neither could be fixed initially. Thus an immediate consideration was that of the criteria to be used in evaluating the creep performance of the candidate materials. The following rationale led to selecting a 20% tensile strain as the standard test condition. First, the reasons for using tensile loading are: (1) convenient dead weight loading can be used; (2) the specimen and load are self-aligning and require no costly fixturing; (3) specimens are easily die cut from readily cast or molded sheets; (4) the specimen cross-section is small relative to that required for a stable compression sample and thus the loads are smaller; (5) many samples can be loaded in a relatively small space; and, (6) tensile creep is more severe than compression creep for all materials of interest and thus evaluation results tend to be conservative.

The 20% strain was estimated to be moderately severe for the geometry that would eventually evolve. This stems from the fact that initial concepts called for an 8% pad precompression or interference fit of the MX missile into the canister. If the overall pad volume is about 50% void space, then a multiplier of 2 will result. One might argue that selecting 20% strain leads to large stress difference between materials depending on their moduli, perhaps up to multiples of 4 or 5. However, precompression and allowable eccentricity when the canister is horizontal are both deflection or strain considerations, not stress. Thus, if a higher modulus material is considered, the void space will increase commensurately such that the material strain remains about the same.

Experimental data will be presented in five sections for different type elastomers.

NR Formulations—NR and particulary deproteinized natural rubber (DPNR) with the soluble efficient vulcanization (EV) system and soluble zine soap activators are the most creep resistant elastomer formulations reported. To compare creep data obtained under the above conditions, a number of NR compounds were tested; the formulations and physical properties are given in Table 1.

Several things are apparent from reviewing the data. Perhaps most significant is that some formulations exhibit low initial creep rates but later the rate increases, probably as the stretched sample is attacked by $O_3$.

Compounds 9, 10 and 15 gave low creep. Compound 15 was selected as having the best balance of properties of all the NR formulations, and small scale support pads were molded and put on compressive creep test. The compressive creep performance of these pads will be discussed later.

In addition to tensile creep testing of compound 15 in air, tests in dry nitrogen ($N_2$) were conducted. The percent relative creep is improved significantly, decreasing from 16.7% after 400 days in air to 4.9% after 895 days in $N_2$.

Surface treatment of the rubber with antidegradants (formulation 10) was shown to improve creep because of the reduced rate of $O_3$ attack. The untreated control specimen exhibits 21.0% relative creep and considerable cracking after 465 days, while another sample of 10 treated with Black Out Black shows 16.4% after 837 days. While a third sample treated with Antozite 2 showed no improvement, giving 24.8% relative creep after 495 days, the sample shows no cracks and 39.0% relative creep after 881 days.

Although not investigated extensively, the intensity of $O_3$ attack could be reduced by mixing antidegradants into the rubber stock. Also, the carbon black was held to relatively low concentrations to minimize creep. However, because of poor $O_3$ resistance over a 15 year life, NR was eliminated from consideration.

Miscellaneous Rubber Formulations - Also evaluted were an SBR (compound 20), several Hydrins (compounds 21 and 22), several polyurethanes (compounds 23, 24, and 25) and one silicone rubber (compound 26) as shown in Table II. In general, the results are not as good as the best NR formulation. The Estane polyurethanes give creep results that are similar to those obtained for Adiprene L-100/MOCA (not shown) and Adiprene L-167/MOCA (compound 25). The main reason for considering Hydrin is its reported inherent $O_3$ resistance compared to natural rubber, while the main reason for considering polyurethane is its relative case of fabrication, $O_3$ resistance and our prior experience.

As reported in the above-mentioned article, it was decided to conduct room temperature creep experiments over as long a period of time as possible and then extrapolate to 15 years, keeping in mind that for highly unsaturated polymers (e.g., NR, SBR, NBR) in thin cross-sections (such as pad struts), the extrapolation is tenuous. With rubbers that are less unsaturated or more $O_3$ resistant (e.g., CR and EPDM), the long range prediction is much more certain.

Others have presented creep or stress relaxation data at elevated temperature for NR, SBR, CR, NBR, IIR, Viton A, VSi and MSi, but have not attempted to make long term predictions regarding service life at or near room temperature and, in general, have not employed the strain level that we selected.

Also evaluated was one silicone rubber (compound 26) which was found to creep excessively at room temperature. If a high temperature application was intended, the silicone formulation could be of more interest.

CR Formulations—As with the Hydrins, the main reason for evaluating CR formulations was greater inherent $O_3$ resistance compared to NR. Also, reference 29 showed CR to have a slightly higher initial creep rate than NR, but the values converged at about 4 years. Attempts to trace the formulations in the DuPont archives proved unsuccessful. However, since the creep work was done before 1946, neither the NR formulations nor the CR formulations could be expected to possess the same creep performance as modern formulations using more efficient vulcanization systems.

The basic CR formulation tested was a tensile slab of compound 27, which gave excellent relative creep response of 22.0% after 702 days as shown in Table III. Other formulations shown in the table were modifications of formulation 27. With minor modifications—change in carbon black level and type, and elimination of antidegradant—the percent relative creep either remained essentially unchanged or was slightly lower.

Samples 32 and 33 using WRT gave much poorer creep results than formulation 27.

Although CR formulation 27 represented an improvement over NR stock 15 with respect to $O_3$ resistance, it still did not pass the stringent exposure test of 27,000–30,000 pphm $O_3$ at 21° C. for 5 days.

EPM Rubber Formulations—Although EPM formulations 34–38 survived the $O_3$ testing, the creep values shown in Table IV are, in general, quite high. Further compounding effort might reduce the creep.

EPDM Rubber Formulations—Many EPDM's were found to have adequate $O_3$ resistance. Several were compounded and evaluated for creep performance. Several formulations with Epsyn 7506 (Table V) gave very impressive creep response after approximately 1.5 years at room temperature in an atmosphere containing 1–3 pphm $O_3$; the well-documented $O_3$ resistance of EPDM should not change the results at 25 pphm.

The first two formulations (39 and 40) were evaluated early in the test program and exhibited not only a good balance of physical properties but excellent creep performance. Another material, compound 49, showed even better creep performance and acceptable physical properties.

Utilizing the base polymer Vistalon 6505, the formulations and creep performance given in Table VI were obtained. Several of these formulations—notably 56, 57 and 58—gave excellent results.

A group of miscellaneous EPDM formulations are given in Table VII, but the relatively poor creep performance caused us to reject all from consideration, except compound 73. This material has potential and is somewhat lower in creep than some of the materials of Table V.

Formulations 74, 75 and 76 were taken largely from a history of elastomeric springs for the Minuteman lauch system. The only difference between compounds 74, 75 and 76 and the reference formulation is the plasticizer and antioxidant level. The percent relative creep of these materials is unacceptable at 59–164% in less than 1 week at room temperature. Creep performance, however, was not required for the vertically stowed Minuteman pads.

Data for the leading EPDM candidates are shown in FIG. 1 (a-d). Compound 43 has a very low (5.6 MPa) tensile strength; all others are above 9.7 MPa. This factor becomes important in demolding EPDM pieces as the hot tensile strength of EPDM is relatively low. Tensile creep data for several of the leading NR, CR and EPDM formulations are summarized in FIG. 2.

In a previous section the virtues of NR formulation 15 were discussed. Since this material was a leading candidate, several pads were molded to the shape shown in FIG. 3 for creep testing. The results of these up to 1.4y tests are typified in FIG. 4. It should be noted that the highly stressed strut area subjected to ambient 1—3 pphm $O_3$ suffered minor attack; numerous small cracks were observed on the strut surface at the location of maximum tensile strain. By comparison, Neoprene pads used in the Poseidon launch system for the last 6–7 years have not exhibited such cracking under less than 9% strain and estimated $O_3$ levels of 1–5 pphm.

Figure 4:
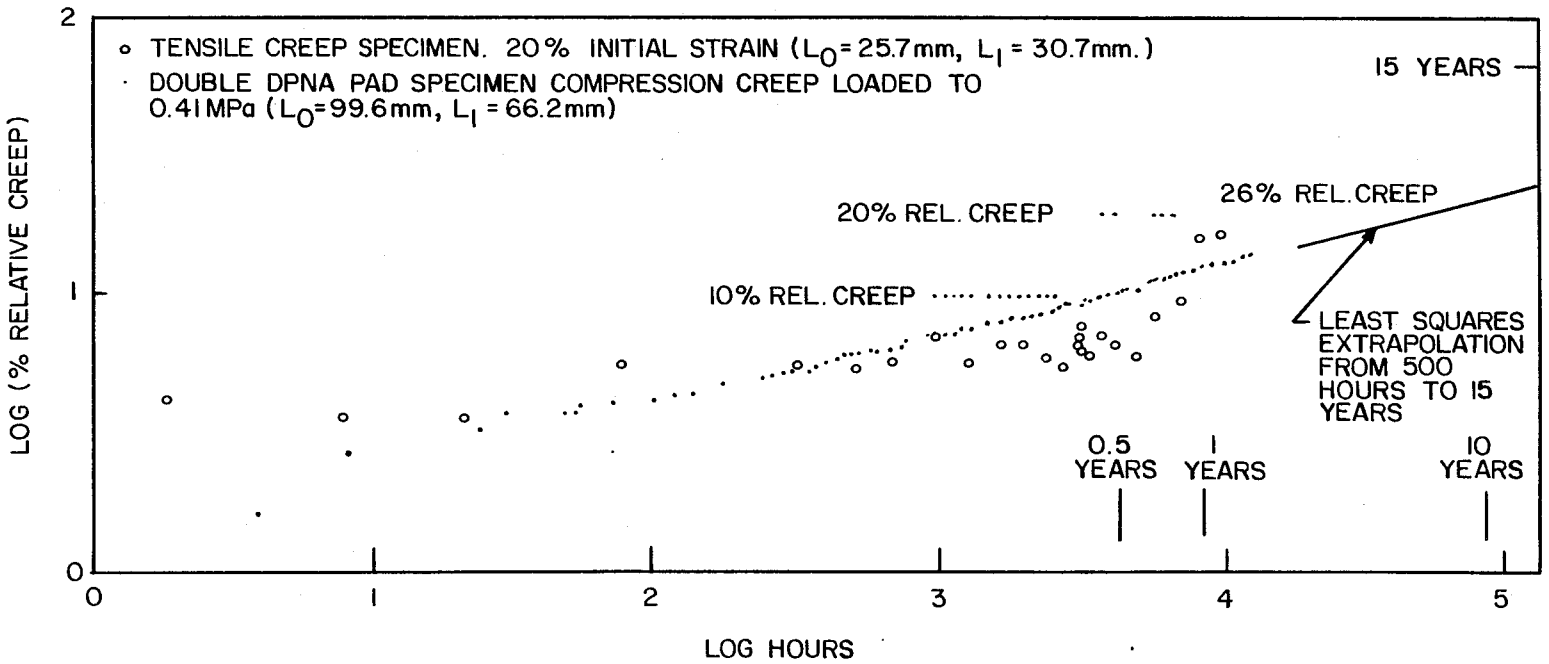
FIG. 4 is a log-log plot of tensile and compressive creep of DPNR compound 15.

Extrapolations for 15 year service can be made using FIG. 4. Assuming log percent relative creep is linear with log time after about 500 hours (log =2.7), the 15 year predicted creep would be 26%. It can be calculated what this prediction means in terms of pad height or thickness, $L_t$, at 15 years. For a relative creep of 26%:

$$0.26=(L_t-L_t)(L_t-L_{30}(L_t-66.2)/(66.2-99.6) \text{ or}$$
$$L_t=57.4 \text{ mm.}$$

The NR tensile creep results plotted in FIG. 4 hint of slightly increasing slope after one year, perhaps reflecting the fact that the sample had numberous cracks by the time the test was terminated. This cracking may also account for the slightly concave upward nature of the compressive creep curve, since the outer surfaces of the strut are strained in tension.

Neither of the extrapolations directly addresses the influence that fourteen or so years of additional aging may have on creep. Aging may produce stiffness changes more subtle than cracking. Neither do the creep tests include the effects of periodic cyclic deformations that will also occur in service.

One SMR5 pad was also put on compressive creep test loaded at 0.14 MPa pad stress for three years. FIG. 5 shows that the linearity on a log-log scale held quite well in spite of noticeable ozone cracking of the strut surfaces, particularly at the notch area. This performance is in contrast to $O_3$-cracked tensile creep performance, where the cracks have much more influence on the comparatively thin specimen. However, formulations 15 (Table I) and HAS6-84-2 (FIG. 5) are significantly different, as evidenced by creep performance.

Figure 7A:
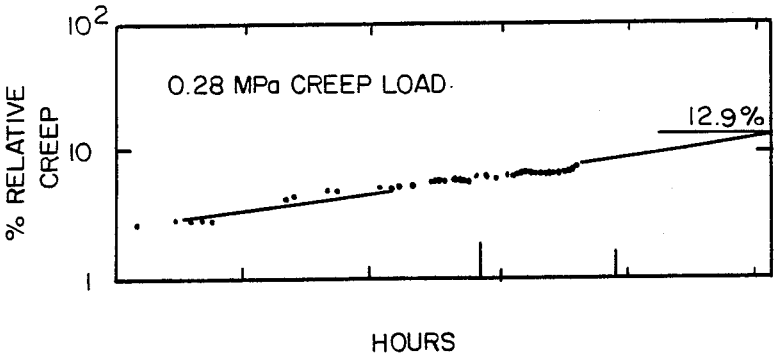
FIG. 7 (*a–b*) shows log-log compressive creep plots for pads of EPDM formulation 49 of the NS2 design of FIG. 9(*a*), with least squares extrapolation to 15 years.
Figure 7B:
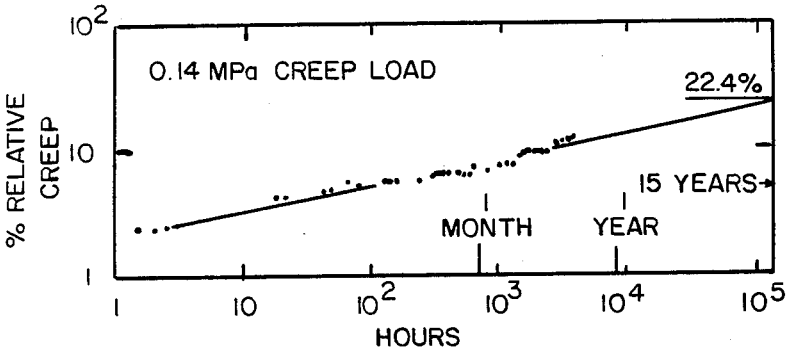
Figure 8A:
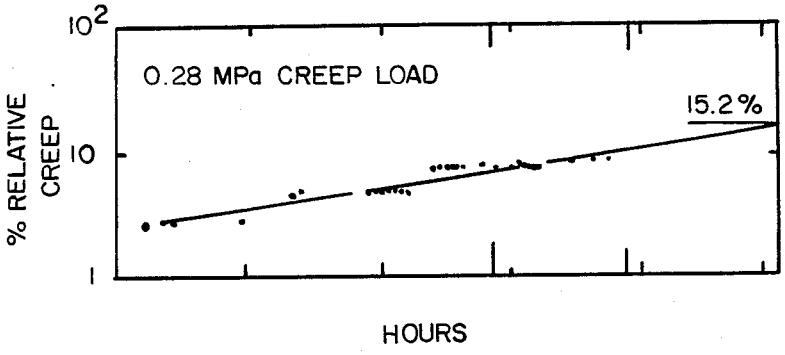
FIG. 8 (*a–b*) shows log-log compressive creep plots for pads of EPDM formulation 49 of the NS4 design of FIG. 9(*b*), with least squares extrapolation to 15 years.
Figure 8B:
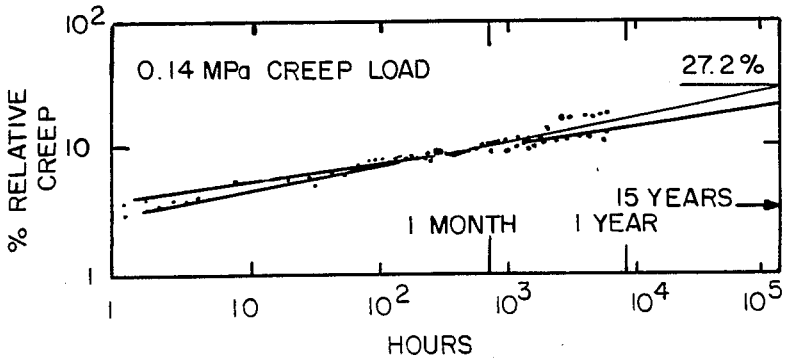

Six nominally 53 mm thick EPDM pads of the designs shown in FIG. 6 were also tested in the above-said report. Log-log creep plots for these tests are shown in FIGS. 7 and 8.

Using a least square extrapolation, the 15 year relative creep should be less than 28%. In absolute terms, 28% relative creep means that a pad which is initially 52.8 mm thick ($L_0$) and is 40.1 mm thick after 1 minute of loading ($L_t$) will be:

$$L_t=L_1+0.28(L_t-L_0)=36.5 \text{ mm thick after 15 years.}$$

The 40.1 mm $L_1$ value is the average for the two NS4 pads loaded to 0.27 MPa pad stress. The creep data indicate that 28% creep is an appropriate estimate for both the 0.14 MPa and the 0.28 MPa loaded samples, if the $L_1$ value for the 0.14 MPa samples is used:

$$L_t=44.9+0.28(44.9-52.8)=42.7 \text{ mm after 15 years.}$$

Figure 10:
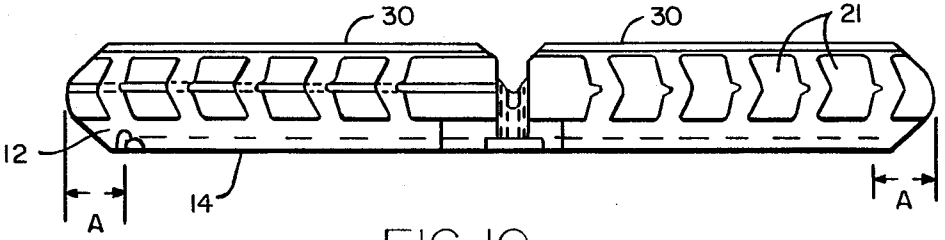
FIG. 10 is a side view of the embodiment of FIG. 9, deformed into a flat contour.
Figure 11:
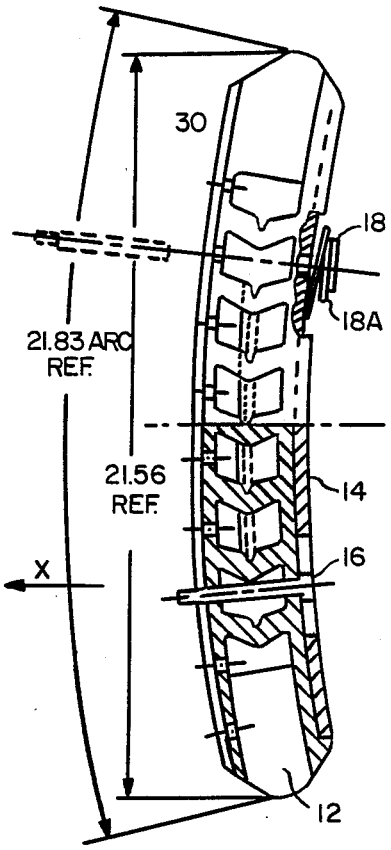
FIG. 11 is a partial cross-sectional view taken along line III—III of FIG. 9.

FIGS. 10 and 11 give 15 years prediction of less than 28% relative creep for a pad in compression which is nearly identical to the EPDM tensile creep sample in FIG. 2.

Figure 9:
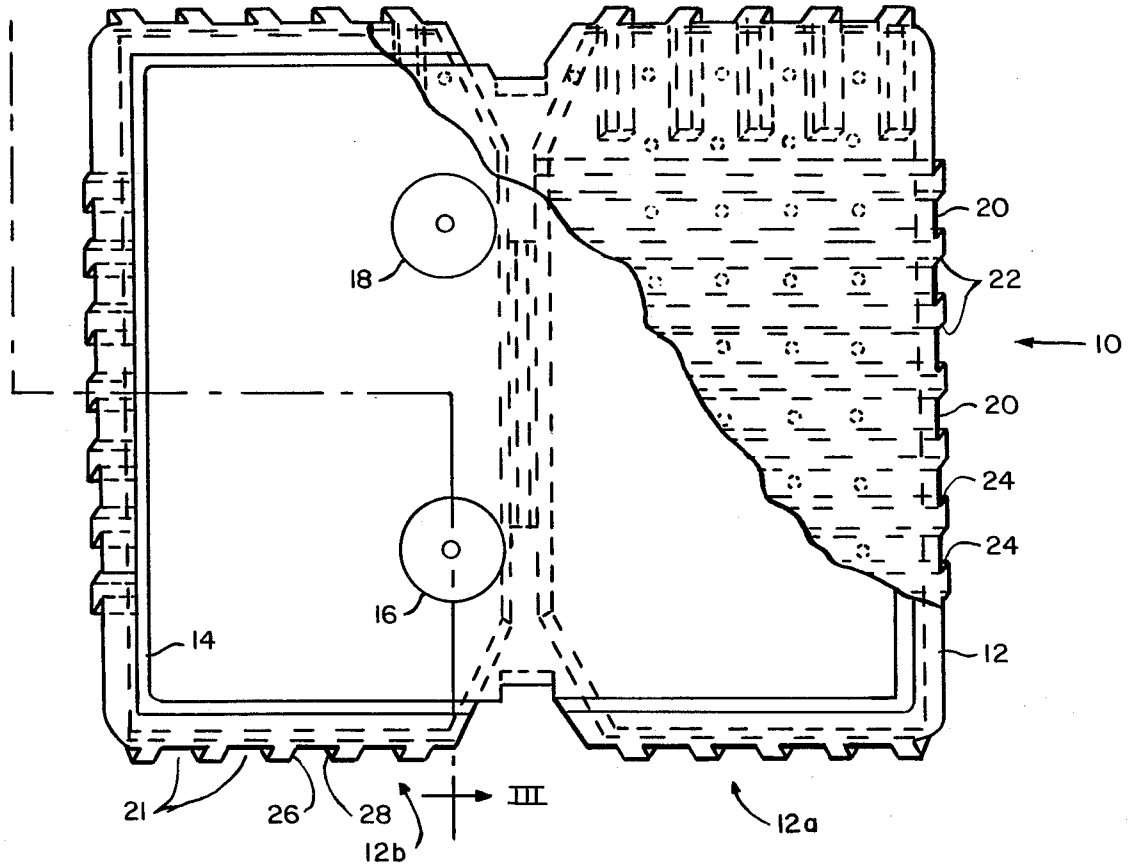
FIG. 9 is a segmented bottom view of a preferred embodiment of the present invention.

The present invention relates to both structure and composition of a shock absorbing missile launch pad for MX missiles. As for structure, referring to FIG. 9 there is shown a segmented bottom view of a preferred embodiment of the present invention. In the embodiment of FIG. 9, a preferred configuration of pad 10 is shown. Pad 10 comprises a convex upper surface (not shown) and a concave bottom surface (which concavity is not apparent in this Figure). Pad 10 is further comprised of resilient element 12 having a bottom support plate 14 attached thereto. Element 12 is comprised of two cooperating pad formations 12*a*, 12*b*. Defined within plate 14 are two circular spring-receiving depressions 16, 18, to be discussed later.

Resilient element 12 defines a multiplicity of latitudinal cavities 20 and longitudinal cavities 21. Cavities 20 are defined by walls 22, 24 of parts 12*a* and 12*b* of element 12, and extend latitudinally from the outer perimeters of parts 12*a* and 12*b* toward the center of element 12, as shown. Cavities 21 are defined by walls 26, 28 of element 12, and extend longitudinally from the outer perimeters of parts 12*a* and 12*b* of element 12 toward the interior of element 12, as shown.

As seen in FIG. 9, resilient element 12 overhangs support plate 14 at the perimeter of element 12 so as to define a protective bumper area surrounding pad 10.

Referring now to FIG. 10, a side view of the embodiment of FIG. 9 is disclosed, deformed into a flat contour. In the embodiment of FIG. 10, the contour of cavities 21, which is like the contour of cavities 20, is shown. This particular contour, referred to as type "NS12", has been selected in view of particular compression and force distribution characteristics, as discussed later. FIG. 10 clearly shows that element 12 overshoots support plate 14 to create the above-described bumper area; the bumper area is identified in FIG. 10 as letter "A" and will be understood to surround pad 10. Further shown in FIG. 10 is Teflon-fiberglass coating 30 affixed to pad 10 at the top surface of element 12.

Referring now to FIG. 11, there is shown a partial cross-sectional view of pad 10 taken along line III—III of FIG. 9. The embodiment of FIG. 11 comprises resilient element 12, which is shown as it is normally bowed convex in the direction of arrow "X", and also comprises support plate 14, which is similarly bowed in the direction of arrow "X". As well, as seen in FIG. 11, low coefficient of friction laminate 30 is affixed to the top convex surface of element 12.

In the sectional view of FIG. 11, spring 18*a* is shown in compressed state within recess 18. A second spring cooperates in a like manner with recess 16, but is not shown in FIG. 11. These springs are designed to compress when pad 10 is fixed adjacent the missile skin, and will cause the pad 10 to be urged away from the missile upon launch. In this manner, damage to the skin of the missile may be avoided by inadvertent contact with the pad, and particularly with its support plate 14, at launch.

It will now be understood that pad 10 comprises an EPDM molded rubber pad element 12 having a Teflon-fiberglass laminate 30 bonded to the outer convex surface thereof, and having a support plate 14 bonded to the inner concave surface thereof, as described above. Plate 14 is preferrably comprised of a fiberglass reinforced plate bonded to the inner concave surface of pad 10.

The particular formulation of resilient element 12 preferred in practice of the present invention is described as:

| | |
|---|---|
| Vistalon 2504 | 100.0 phr |
| N762 Carbon Black | 40.0 |
| DiCup 40KE | 7.5 |
| | 147.5 |

This formulation meets the following standards:

VISTALON 2504

A. Specific Gravity—0.86±0.02 (ASTM D792-66);
B. "Mooney" viscosity of Raw Gum ML 1+8 at 257° F.; 70±5;
C. Volatile Matter % 0.75 maximum when tested per ASTM 1414-76; and
D. Ash, % (burn off method) 0.20 maximum when tested per ASTM 1416-76.

Rheometer Testing:

A. Test recipe for Rheometer test per ASTM D3568-77 has the following limits, for the following formulation:

| (Parts by weight) | |
|---|---|
| Vistalon 2504 | 100.00 ± 0.5% |
| IRB #5 N330 Black | 80.00 ± 0.5% |
| Circosol 420 (ASTM Type 103) | 50.00 ± 0.5% |
| NBS 370 Zinc Oxide (ZNO) | 5.00 ± 0.5% |
| NBS 372 Stearic Acid | 1.00 ± 0.5% |
| NBS 371 Sulfur | 1.50 ± 0.5% |
| NBS 374 TMTD | 1.00 ± 0.5% |
| NBS 383 MBT | 0.50 ± 0.5% |

B. Test Conditions Nominal test conditions 320° F.−1° ARC, 50 range, 100 CPM chart motor: 30 minute.
C. Rheometer Test Requirements, where t5=torque at 5 minutes and t'C=90% of maximum:

| | Minimum | Maximum |
|---|---|---|
| ml, inch lbs | 3.5 | 7.5 |
| ml, inch lbs | 25.0 | 35.0 |
| $t5^2$, minutes | 3.0 | 5.0 |
| t'C(90) minutes | 15.0 | 19.0 |

N762 CARBON BLACK

A. Appearance—black powder;
B. Iodine adsorption—No. (ASTM D1510)—26.0±0.5 g/Kg;
C. Dibutyl Phthalate (DBP)—No. (ASTM D2414)—62.0±1.5 $cm^3$/100 g; and
D. Pour density—No (ASTM D1513)—505±10 Kg./$M^3$ (31.5±0.6 lb/$ft^3$).

DICUMYL PEROXIDE

A. Specific gravity 77° F. (25° C.)—1.53—1.58 (per ASTM D792-66);
B. Melting point of Dicumyl Peroxide—100° F. (37.8° C.)±3° F. (ASTM E324-69); and
C. Peroxide content of 39.5–41.5%.

Figure 12:
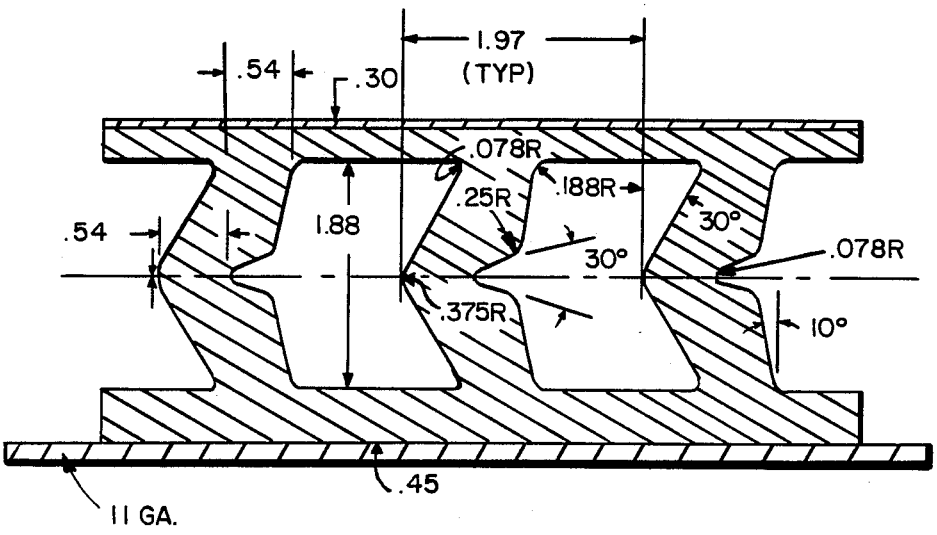
FIG. 12 is a simplified side cross-sectional view of an NS12 designed embodiment of the present invention, used with EPDM compound VISTALON.
Figure 13:
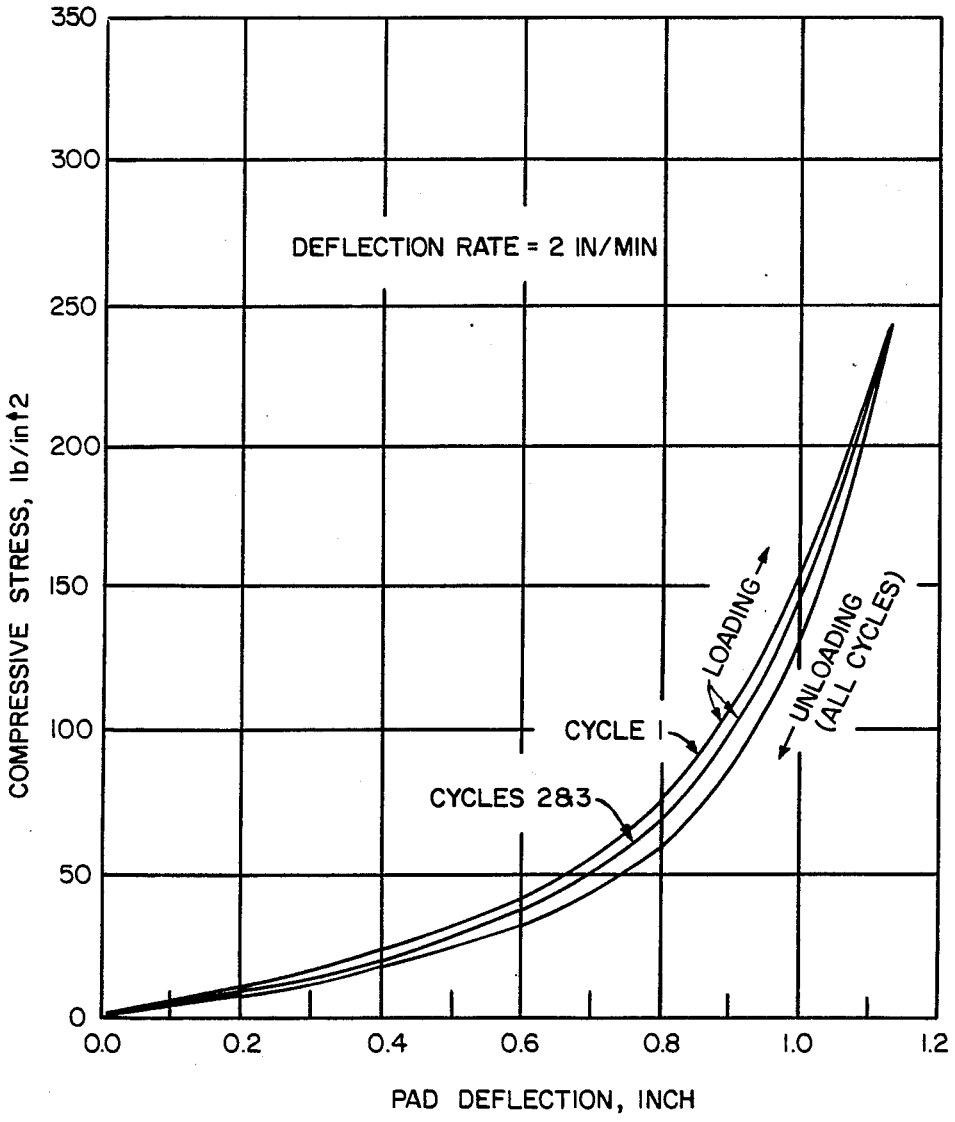
FIG. 13 is a graphical representation of the force-deflection characteristics for a nine inch long, three strut embodiment of the present invention.

Referring now to FIG. 12, there is provided a simplified side cross-sectonal view of an embodiment of the present invention comprised of the preferred EPDM compound VISTALON 2504. The dimensions of the NS12 strut configuration are as shown. This NS12 configuration exhibits desired force-reflection characteristics as shown in FIG. 13. FIG. 13 is a graphical representation of such characteristics for a nine inch long, three strut pad sample, where compressive stress is compared to pad deflection.

Figure 14:
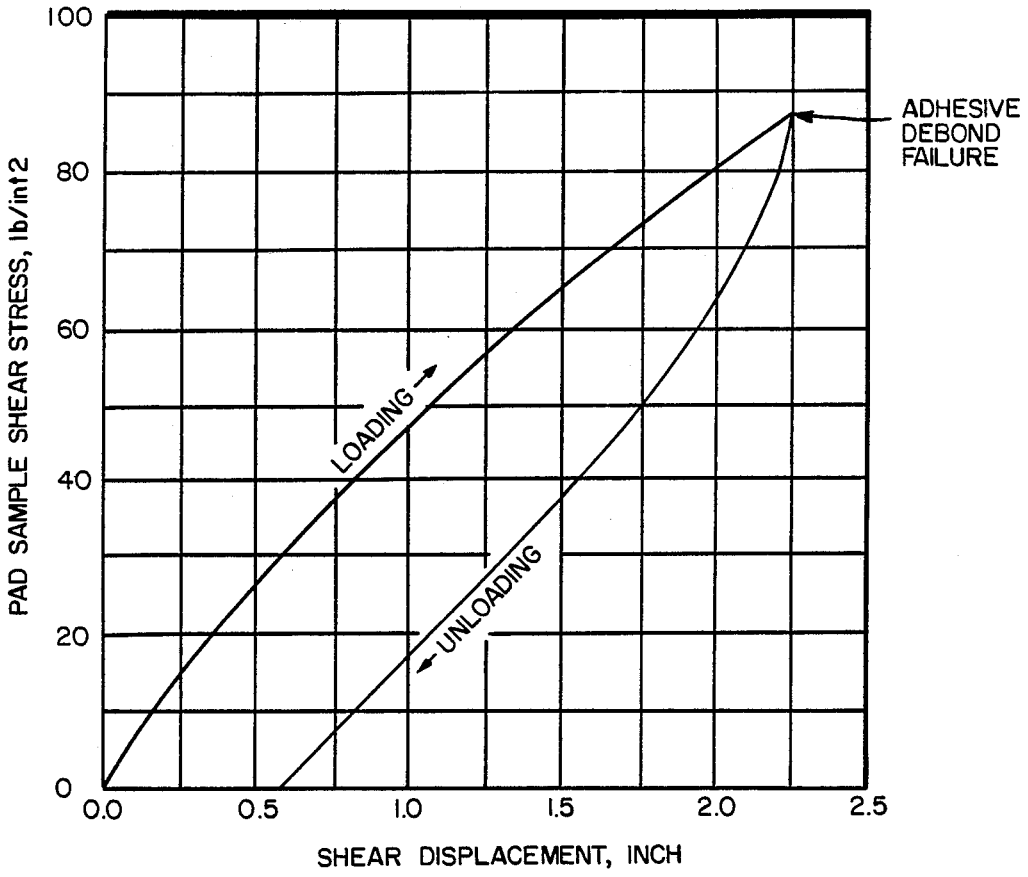
FIG. 14 is a graphical representation of ultimate shear test results of the embodiment of FIG. 13.
Figure 15A:
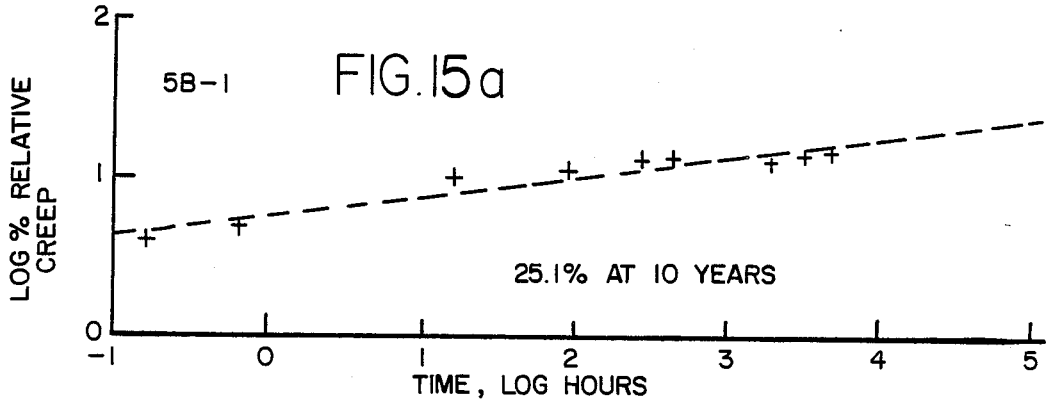
FIG. 15 (*a–d*) is a graphical representation of tensile creep of four samples of the EPDM compound of the present invention.
Figure 15B:
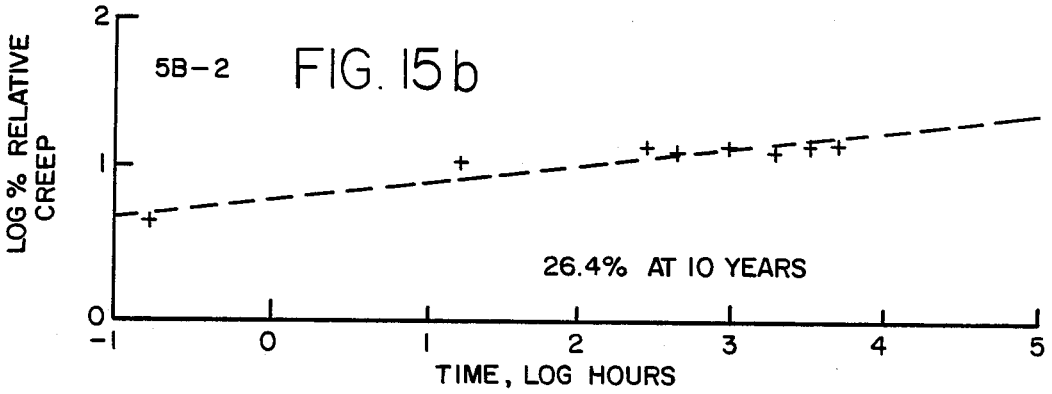
Figure 15C:
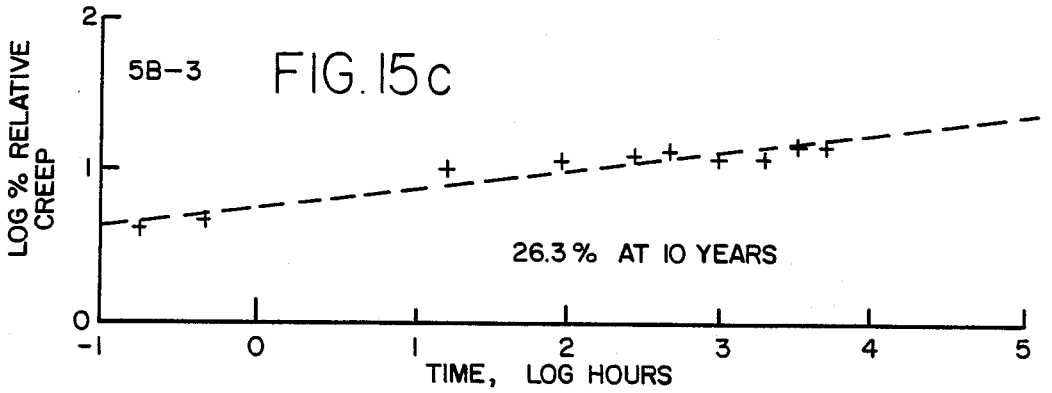
Figure 15D:
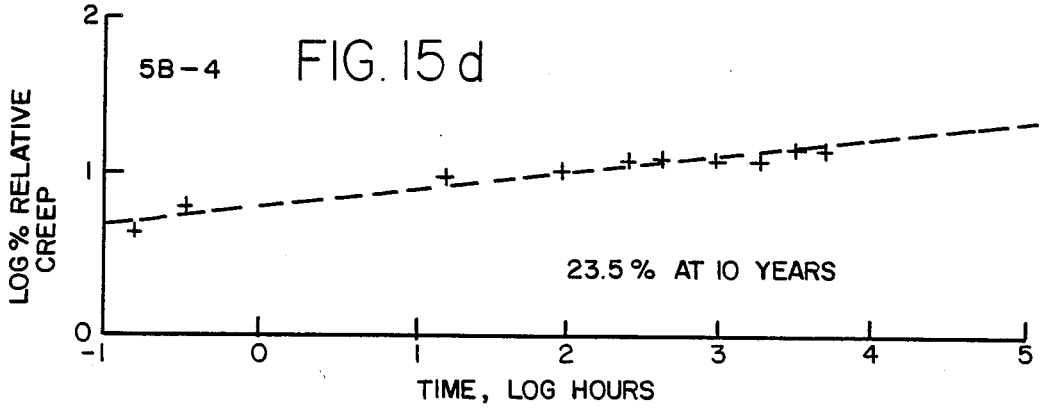

FIG. 14 graphically represents ultimate shear test data of the pad of FIG. 13, where pad sample shear stress is compared to shear displacement. FIG. 15 represents tensile creep for four samples of the preferred VISTALON EPDM compound of the present invention, where the percent of relative creep is compared to time of test.

The results of these tests indicate that the above combination of Vistalon 2504 (100.0 phr), N762 Carbon black (40.0) and DiCup 40KE (7.5), yields a shock absorbing missle launch pad having improved compression, force-deflection and shear displacement characteristics over the prior art.

In practice of a preferred embodiment of the present invention, a pad assembly 10 comprises a molded EPDM rubber pad 12, having NS12 force-deflection cavities defined therein. The pad is formulated as described above. A Teflon laminate surface 30 is affixed at the outer surface of the assembly and a reinforced backing plate 14 is bonded to the inner surface thereof. The pad element 12 and plate 14 cooperate in such a fashion that bumper areas are defined to overhang the backing plate 14 about its perimeter.

The pad assemblies 10 are circumferentially held by strapping to an MX missile skin at numerous locations along its length to provide alignment and shock absorbtion interface between the missile and the missile container. The Teflon laminate provides a low-friction surface during launch against the container interior wall surface.

The abovesaid strapping is released at launch and the pad assemblies are jettisoned. The springs, as placed in spring receiving recesses 16, 18, urge the pad assemblies away from the missile at launch to minimize interference therewith. This prevents possible damage to the missile skin as might be caused by collision with the support plate 14. Further protection is provided by the bumper areas of resilient element 12 which overhang plate 14.

TABLE I

NATURAL RUBBER FORMULATIONS, PHYSICAL PROPERTIES & TENSILE CREEP DATA AT ROOM TEMPERATURE

| | 1 | 2 | 3 | 4 | 5 | 6 | 7 |
|---|---|---|---|---|---|---|---|
| SMR5 | 100 | 100 | 100 | 100 | 100 | — | 100 |
| Deproteinized natural rubber (DPNR) | — | — | — | — | — | 100 | — |
| Stearic acid | — | — | 2 | 2 | 1 | — | — |
| Lauric acid | 1 | 1 | — | — | — | 1 | 1 |
| ZnO | 5 | 5 | 5 | 5 | 5 | 5 | 5 |
| SRF-LM-NS(N 762 black) | 40 | — | — | — | — | 10 | 10 |
| Polymerized 2,2,4-trimethyl-1,2-dihydroquinoline | 1.5 | 1.5 | — | — | 2.25 | 1.5 | 1.5 |

TABLE I-continued

NATURAL RUBBER FORMULATIONS, PHYSICAL PROPERTIES & TENSILE CREEP DATA AT ROOM TEMPERATURE

| | | | | | | | | | | | | | | |
|---|---|---|---|---|---|---|---|---|---|---|---|---|---|---|
| Phenyl-β-naphthylamine | | — | | | | — | | — | — | — | 0.75 | — | | — |
| N—Isopropyl-N'—phenyl-ρ phenylenediamine | | — | | | | — | | — | 1.0 | — | — | | | — |
| CBS | | 0.54 | | | | 0.54 | | 0.6 | 0.6 | — | 0.54 | | | 0.54 |
| TMTD | | — | | | | — | | — | — | 0.66 | — | | | — |
| MOR | | — | | | | — | | — | — | 1.4 | — | | | — |
| Sulfur | | 2.7 | | | | 2.7 | | 2.5 | 2.5 | 0.35 | 2.7 | | | 2.7 |
| Cure conditions, Time (min)/Temp. (°C.) | | 30/140 | | | | 30/140 | | 40/140 | 40/140 | 30/150 | 30/140 | | | 30/140 |
| Tensile Strength, MPa | | 21.0 | | | | 11.3 | | 9.8 | 11.7 | 19.2 | 22.4 | | | 20.9 |
| % Elongation | | 600 | | | | 670 | | 700 | 700 | 540 | 730 | | | 700 |
| Hardness, Shore A | | — | | | | — | | — | — | — | 40 | | | 44 |
| Air or $N_2$? | Air | Air | Air | Air | Air | Air | $N_2$ | Air | Air | Air | Air | Air | Air | Air |
| Relative Humidity | Low[a] | High[b] | Ambient | Ambient | Ambient | Ambient | Low | Ambient | Ambient | Ambient | Ambient | Ambient | | Ambient |
| % Relative Creep | 13.1 | 27.5 | 308.2 | 387.3 | 100.0 | 356.2 | 25.2 | 247.7 | 270.6 | 298.8 | 255.4 | 22.4[c] | 243.6[d] | 28.6[e] |
| Time on test, days | 6 | 6 | 392 | 412 | 275 | 449 | 1016 | 275 | 382 | 526 | 499 | 964 | 405 | 69 |

[a]Dessicant around specimen.
[b]Water saturated wick around specimen.
[c]Prestressed to 90 psi before creep testing.
[d]Prestressed to 54 psi before creep testing.
[e]Prestressed to 90 psi before creep testing.

| | 8 | 9 | 10 | 11 | 12 | 13 | 14 | 15[e] |
|---|---|---|---|---|---|---|---|---|
| DPNR | — | 100 | 100 | — | — | — | — | 100 |
| SMR5 | 100 | — | — | 100 | 100 | 100 | 100 | — |
| ZnO | 5 | 5 | 5 | 5 | 5 | 5 | 5 | 5 |
| Lauric acid | 1 | — | — | 2 | 2 | 2 | 2 | 2 |
| Zn-2 ethyl hexanoate | — | 1.5 | 1.5 | — | — | — | — | 1.5 |
| Polymerized-2,2,4-trimethyl-1,2-dihydroquinoline | 1.5 | 2 | 2 | 2 | 2 | 2 | 2 | 2 |
| SRF-LM-NS(N 762 black) | 25 | 20 | 10 | — | 20 | 10 | 20 | 10 |
| Sulfur | 2.7 | 0.7 | 0.7 | — | — | — | — | 0.7 |
| MOR | — | 1.7 | 1.7 | — | — | — | — | 1.7 |
| Tetrabutyl thiuram disulfide | — | 0.7 | 0.7 | — | — | — | — | 0.7 |
| N—1,3-dimethylbutyl-N'—phenyl-ρ-phenylenediamine | — | — | — | 2 | 2 | 2 | 2 | — |
| Dimorpholino disulfide | — | — | — | 2 | 2 | 2 | 2 | — |
| CBS | 0.54 | — | — | — | — | — | — | — |
| TBBS | — | — | — | 2 | 2 | 2 | 2 | — |
| TMTD | — | — | — | 0.3 | 0.3 | 0.3 | 0.3 | — |
| Cure conditions, Time (min)/Temp. (°C.) | 45/140 | 40/140 | 40/140 | 30/150 | 30/150 | 30/150 | 30/150 | 60/140 |
| Tensile Strength, MPa | 19.4 | 24.1 | 18.7 | 15.1 | 20.2 | 16.4 | 19.9 | — |
| % Elongation | 1000+ | 700 | 720 | 710 | 640 | 655 | 640 | — |
| Hardness, Shore A | 42 | 41 | 39 | 35 | 42 | 39 | 42 | — |
| Air or $N_2$? | Air | Air | Air | Air | Air | Air | Air | $N_2$ |
| % Relative Humidity | Ambient | Ambient | Ambient | Ambient | Ambient | Ambient | Ambient | Low |
| % Relative Creep | 427.7 | 42.6 | 20.9[a] | 21.0 | 39.0[b] | 19.1[c] | 16.4[d] | 44.1 | 34.3 | 37.0 | 44.7 | 16.7 | 4.9 |
| Time on test, days | 380 | 489 | 70 | 465 | 881 | 70 | 837 | 1008 | 1008 | 1008 | 1008 | 400 | 895 |

[a]Pre-stressed to 90 psi before creep testing.
[b]Surface treated with Antoziote 2 surface treatment.
[c]Prestressed to 90 psi before creep testing.
[d]Surface treated with Black Out Black.
[e]Same as JM11-118D except longer mold cure.

| | 16 | 17 | 18 | 19 |
|---|---|---|---|---|
| DPNR | 100 | 100 | 100 | 100 |
| Lauric acid | 1 | 1 | 1 | — |
| SRF-LM-NS(N 762 black) | 10 | 10 | 10 | 2 |
| Polymerized 2,2,4-trimethyl-1,2-dihydroquinoline | — | — | 1.5 | — |
| Sun Anticheck Wax | — | — | — | 1.5 |
| ZnO | 5 | 5 | 5 | 5 |
| N—1,3-Dimethylbutyl-N'—phenyl-ρ-phenylenediamine | 3 | 3 | 3 | 3 |
| N,N'—Bis-(1,4-dimethylpentyl)-ρ-phenylenediamine | 2 | 4 | 2 | 3 |
| MOR | 0.54 | 0.54 | 0.54 | 1.7 |
| Zn—2-ethyl hexanoate | — | — | — | 1.5 |
| Sulfur | 2.7 | 2.7 | 2.7 | 0.7 |
| TBTD | — | — | — | 0.7 |
| Cure conditions, Time (min)/Temp. (°C.) | 45/140 | 45/140 | 45/140 | 60/140 |
| Tensile strength, MPa | 12.9 | 10.7 | 12.6 | 12.9 |
| % Elongation | 800 | 820 | 825 | 740 |
| Hardness, Shore A | 35 | 34 | 35 | 34 |
| Air or $N_2$? | Air | Air | Air | Air |
| % Relative Humidity | Ambient | Ambient | Ambient | Ambient |
| % Relative Creep | 45.3 | 52.9 | 36.7 | 18.6 |

TABLE I-continued

| NATURAL RUBBER FORMULATIONS, PHYSICAL PROPERTIES & TENSILE CREEP DATA AT ROOM TEMPERATURE | | | | |
|---|---|---|---|---|
| Time on test, days | 382 | 382 | 382 | 192 |

TABLE II

MISCELLANEOUS ELASTOMER FORMULATIONS, PHYSICAL PROPERTIES & TENSILE CREEP DATA IN ROOM TEMPERATURE AIR AT AMBIENT HUMIDITY

| | | | | 23 | 24 | 25 | 26 |
|---|---|---|---|---|---|---|---|
| | | | | Polyurethanes[a] | | | |
| | 20 | 21 | 22 | Estane 58064 Nat. | Estane 5740-140 | Adiprene[b] L-167/MOCA | C-508 Silicone[c] |
| SBR 1502 | 100 | — | — | | | | |
| Hydrin 100 | — | 100 | — | | | | |
| Hydrin 200 | — | — | 100 | | | | |
| Red lead (98%) | — | 5 | 5 | | | | |
| ZnO | 5 | — | — | | | | |
| Zinc Stearate | — | — | 1 | | | | |
| Polymerized 2,2,4-trimethyl-1,2-dihydroquinoline | 2 | 1 | — | | | | |
| FEF (N 550 Black) | — | 40 | 40 | | | | |
| TE-80 | — | 1 | 1 | | | | |
| Ethylenethiourea | — | 2 | 2 | | | | |
| $Sb_2O_2$ | — | 15 | 10 | | | | |
| Zn—2-ethyl hexanoate | 1.5 | — | — | | | | |
| Chlorinated paraffin (70% Cl) | — | 15 | — | | | | |
| MOR | 1.7 | — | — | | | | |
| Dechlorane 602 | — | — | 15 | | | | |
| TBTD | 0.7 | — | — | | | | |
| Sulfur | 0.7 | — | — | | | | |
| Nickel dibutyl dithiocarbamate | — | 1 | 1 | | | | |
| Cure conditions, Time (min.)/Temp. (°C.) | 15/153 | 45/154 | 45/154 | | | 20/90 | |
| Tensile Strength, MPa | 2.8 | 13.9 | 10.8 | — | — | 28.9–33.7 | |
| % Elongation | 470 | 785 | 250 | — | — | 340–370 | |
| Hardness, Shore A | 40 | 65 | 73 | — | — | 95 | |
| % Relative Creep | 58.2 | 52.5 | 55.0 | 97.0 | 144.7 | 112.8 | 37.3 |
| Time on test, days | 509 | 511 | 511 | 10 | 10 | 12 | 148 |

[a]Supplied by B F Goodrich Chemical Div.
[b]Adiprene L-167-100, MOCA-13.3.
[c]Stauffer Chemical Co., formulation not available.

TABLE III

NEOPRENE FORMULATIONS, PHYSICAL PROPERTIES & TENSILE CREEP DATA IN ROOM TEMPERATURE AIR AT AMBIENT HUMIDITY

| | 27 | 28 | 29 | 30 | 31 | 32 | 33 |
|---|---|---|---|---|---|---|---|
| Neoprene TRT | 100 | 100 | 100 | 100 | 100 | — | — |
| Neoprene WRT | — | — | — | — | — | 100 | 100 |
| Stearic acid | 0.5 | 0.5 | 0.5 | 0.5 | 0.5 | 0.5 | 0.5 |
| HAF (N 330 black) | 20 | — | — | — | — | — | — |
| SRF-LM NS(N 762 black) | — | 30 | 30 | 40 | 40 | 2 | 5 |
| Process oil | 12 | 12 | 12 | 12 | 12 | — | — |
| Hydrated alumina | — | — | 20 | — | — | — | |
| ZnO | 5 | 5 | 5 | 5 | 5 | 5 | 5 |
| Antimony trioxide | — | — | — | 20 | 30 | — | — |
| MgO | 1 | 1 | 1 | 1 | 1 | 4 | 4 |
| Phenyl-α-naphthylamine | — | 2 | 2 | 2 | 2 | — | — |
| Phenyl-β-naphthylamine | 2 | — | — | — | — | — | — |
| Mixed ditolyl-p-phenylenediamine | — | — | — | — | — | 2 | 2 |
| Tetramethylthiourea | 1.25 | 1.25 | 1.25 | 1.25 | 1.25 | — | — |
| CBS | 0.75 | — | — | — | — | — | — |
| MOR | — | 0.75 | 0.75 | 0.75 | 0.75 | — | — |
| TMTM | — | — | — | — | — | 1 | 1 |
| DOTG | — | — | — | — | — | 1 | 1 |
| Sulfur | — | — | — | — | — | 1 | 1 |
| Cure conditions, Time (min.)/Temp. (°C.) | 30/153 | 30/153 | 30/153 | 30/153 | 30/153 | 45/149 | 45/149 |
| Tensile strength, MPa | 17.9 | 16.4 | 14.1 | 16.6 | 15.3 | 10.0 | 11.1 |
| % Elongation | 410 | 465 | 555 | 365 | 350 | 660 | 615 |
| Hardness, Shore A | 46 | 50 | 50 | 58 | 56 | 48 | 48 |
| % Relative Creep | 22.1 | 24.1 | 37.5 | 15.3 | 26.2 | 51.5 | 50.5 |
| Time on test, days | 702 | 34 | 34 | 552 | 552 | 803 | 803 |

TABLE IV

ETHYLENE PROPYLENE COPOLYMER FORMULATIONS, PHYSICAL PROPERTIES AND TENSILE CREEP DATA IN ROOM TEMPERATURE AIR AT AMBIENT HUMIDITY

| | 34 | 35 | 36 | 37 | 38 |
|---|---|---|---|---|---|
| Vistalon 404 | 100 | 100 | 100 | 100 | 100 |
| ZnO | 5 | 5 | 5 | 5 | 5 |
| Tricresyl Phosphate | — | — | — | 5 | 5 |
| HAF-HS (N347) | 70 | 50 | 35 | 40 | 30 |
| Dicumyl peroxide | 2.8 | 2.8 | 2.8 | 2.8 | 2.8 |
| Sulfur | 0.32 | 0.32 | 0.23 | 0.32 | 0.32 |
| Divinylbenzene | 1.5 | 1.5 | 1.5 | 1.5 | 1.5 |
| Cure Conditions, Time (min.)/Temp. (° C.) | 30/160 | 30/160 | 30/160 | 30/160 | 39/160 |
| Tensile Strength, MPa | 18.0 | 15.4 | 11.9 | 14.6 | 11.3 |
| % Elongation | 350 | 440 | 360 | 450 | 465 |
| Hardness, Shore A | 67 | 55 | 50 | 50 | 45 |
| % Relative Creep | 76.7 | 44.9 | 33.3 | 52.0 | 46.0 |
| Time on Test, days | 510 | 510 | 503 | 485 | 485 |

TABLE V

EPSYN 7506 ETHYLENE PROPYLENE TERPOLYMER) FORMULATIONS, PHYSICAL PROPERTIES AND TENSILE CREEP DATA IN ROOM TEMPERATURE AIR AT AMBIENT HUMIDITY

| | 39 | 40 | 41 | 42 | 43 | 44 | 45 | 46 | 47 |
|---|---|---|---|---|---|---|---|---|---|
| Epsyn 7506 | 100 | 100 | 100 | 100 | 100 | 100 | 100 | 100 | 100 |
| Stearic Acid | 1 | 1 | 1 | 1 | 1 | 1 | 1 | 1 | 1 |
| ZnO | 5 | 5 | 5 | 5 | — | — | 5 | 5 | 5 |
| Polymerized 2,2-4-trimethyl-1,2-dihydroquinoline | — | — | — | — | — | — | 1.5 | 1.5 | 1.5 |
| Sunpar 2280 oil | 20 | 5 | 5 | 5 | 5 | 5 | 20 | 10 | 10 |
| FEF (N550) | 85 | 40 | — | — | — | 60 | — | — | — |
| SRF-LM-NS (N762) | — | — | 10 | 10 | 10 | — | 85 | 60 | 50 |
| Sulfur | 1 | 1 | 1 | 1 | — | — | 1 | 1 | 1 |
| TMTD | 1 | 1 | 1 | 1 | — | — | 1 | 1 | 1 |
| MBT | 0.5 | 0.5 | 0.5 | 0.5 | — | — | 0.5 | 0.5 | 0.5 |
| Dicumyl peroxide | — | — | — | — | 7.5 | 7.5 | — | — | — |
| Cure Conditions, Time (min.)/Temp. (°C.) | 8/166[a] | 45/166[a] | 45/166 | 45/166[b] | 45/166[a] | 30/166 | 45/166 | 45/166 | 45/166 |
| Tensile Strength, MPa | 16.5 | 12.5 | 2.6 | 3.2 | 5.6 | 15.6 | 13.9 | 11.4 | 10.0 |
| % Elongation | 250 | 250 | 260 | 280 | 255 | 260 | 370 | 310 | 330 |
| Hardness, Shore A | 77 | 68 | 53 | 48 | 50 | 65 | 66 | 64 | 60 |
| % Relative Creep | 46.3 | 37.1 | 23.9 | 20.6 | 20.5 | 26.0 | 59.1 | 37.0 | 34.1 |
| Time on Test, days | 1070 | 1013 | 964 | 964 | 909 | 511 | 510 | 510 | 510 |

| | 48 | 49 | 50 | 51 | 52 | 53 | 54 | 55 |
|---|---|---|---|---|---|---|---|---|
| Epsyn 7506 | 100 | 100 | 100 | 100 | 100 | 100 | 100 | 100 |
| Stearic Acid | 1 | 1 | 1 | 1 | 1 | 1 | 1 | 1 |
| ZnO | — | — | 5 | 5 | 5 | 5 | 5 | 5 |
| Polymerized 2,2,4-trimethyldihydroisoquinoline | — | — | 1.5 | — | — | — | — | — |
| Mixed ditolyl-*p*-phenylenediamines | — | — | — | — | 2 | 2 | 2 | 2 |
| Antimony Trioxide ($Sb_2O_3$) | — | — | — | 10 | — | — | — | — |
| Sunpar 2280 | 5 | — | 5 | — | 5 | — | 5 | — |
| FEF (N550) | — | — | — | — | 40 | 40 | 35 | 35 |
| SRF-LM-NS (N762) | 40 | 40 | 40 | 50 | — | — | — | — |
| Sulfur | — | — | 1 | — | 1 | 1 | 1 | 1 |
| TMTD | — | — | 1 | — | 1 | 1 | 1 | 1 |
| MBT | — | — | 0.5 | — | 0.5 | 0.5 | 0.5 | 0.5 |
| Dicumyl peroxide | 7.5 | 7.5 | — | 7.5 | — | — | — | — |
| Cure Conditions, Time (min.)/Temp. (°C.) | 45/160 | 45/160 | 30/166 | 30/166 | 45/166[b] | 45/166[b] | 45/166[b] | 45/166[b] |
| Tensile Strength, MPa | 10.9 | 13.0 | 9.8 | 10.7 | 14.4 | 14.1 | 11.7 | 13.0 |
| % Elongation | 275 | 230 | 370 | 235 | 360 | 320 | 350 | 335 |
| Hardness, Shore A | 56 | 62 | 58 | 67 | 62 | 66 | 61 | 65 |
| % Relative Creep | 22.7 | 17.8 | 49.1 | 37.4 | 48.1 | 48.7 | 46.6 | 48.4 |
| Time on Test, days | 506 | 506 | 505 | 511 | 490 | 490 | 490 | 490 |

[a]Also given a postcure of 48 hr at 121° C.
[b]Also given a postcure of 61 hr at 121° C.

TABLE VI

VISTALON 6505 (ETHYLENE PROPYLENE TERPOLYMER) FORMULATIONS, PHYSICAL PROPERTIES AND TENSILE CREEP DATA IN ROOM TEMPERATURE AIR AT AMBIENT HUMIDITY

| | 56 | 57 | 58 | 59 | 60 | 61 | 62 | 63 |
|---|---|---|---|---|---|---|---|---|
| Vistalon 6505 | 100 | 100 | 100 | 100 | 100 | 100 | 100 | 100 |
| Lauric Acid | 1 | 1 | 1 | — | — | — | — | — |
| Stearic Acid | — | — | — | 1 | 1 | 1 | 0.5 | 0.5 |
| ZnO | 5 | 5 | 5 | 5 | 5 | 5 | 5 | 5 |
| HAF (N330) | — | — | — | 50 | 50 | — | — | — |
| MT (N990) | — | — | — | 50 | — | — | — | — |
| SRF-LM-NS (N762) | 25 | — | — | 50 | 50 | 50 | 40 | 50 |
| FEF (N550) | — | 30 | 30 | — | — | — | — | — |
| Polymerized 2,2,4-trimethyl-1,2-dihydroquinoline | 1.5 | — | — | — | — | — | — | — |

TABLE VI-continued

VISTALON 6505 (ETHYLENE PROPYLENE TERPOLYMER) FORMULATIONS, PHYSICAL PROPERTIES AND TENSILE CREEP DATA IN ROOM TEMPERATURE AIR AT AMBIENT HUMIDITY

| | 56 | 57 | 58 | 59 | 60 | 61 | 62 | 63 |
|---|---|---|---|---|---|---|---|---|
| Sunpar 2280 oil | — | 5 | — | — | — | — | — | — |
| Naphthenic oil | — | — | — | 40 | 20 | 5 | — | — |
| CBS | 0.54 | — | — | — | — | — | — | — |
| Sulfur | 2.7 | 1.5 | 1.5 | 4 | 4 | 4 | 1.5 | 1.5 |
| TMTD | — | 1.5 | 1.5 | — | — | — | 1.5 | 1.5 |
| MBT | — | 0.5 | 0.5 | 2 | 2 | 2 | 0.5 | 0.5 |
| TDEDC (80%, Tellurac) | — | — | — | 2.5 | 2.5 | 2.5 | — | — |
| Cure Conditions, Time (min.)/Temp. (°C.) | 45/140 | 45/140 | 45/140 | 60/132 | 60/132 | 60/132 | 50/166 | 60/166 |
| Tensile Strength, MPa | 7.3–9.7[a] | 8.8–9.7[a] | 8.3–9.6[a] | 13.3 | 17.3 | 10.3 | 8.9 | 13.2 |
| % Elongation | 250 | 350 | 310 | 115 | 115 | 125 | 240 | 300 |
| Hardness, Shore A | 57 | 60 | 64 | 88 | 85 | 74 | 66 | 66 |
| % Relative Creep | 42.0 | 37.9 | 44.7 | 57.2 | 44.3 | 30.6 | 33.9 | 36.0 |
| Time on Test, days | 1007 | 881 | 881 | 491 | 498 | 498 | 485 | 485 |

[a]Values obtained on two different test machines.

TABLE VII

MISCELLANEOUS ETHYLENE PROPYLENE-TERPOLYMER FORMULATIONS, PHYSICAL PROPERTIES & TENSILE CREEP DATA IN ROOM TEMPERATURE AIR AT AMBIENT HUMIDITY

| | 64 | 65 | 66[a] | 67[a] | 68 | 69[a] | 70[a] | 71[a] | 72[a] | 73 |
|---|---|---|---|---|---|---|---|---|---|---|
| Nordel 1040 | 100 | 100 | — | — | — | — | — | — | — | — |
| Epsyn 40A | — | — | 50 | 50 | — | — | — | — | — | — |
| Epsyn 5508 | — | — | 50 | 50 | — | — | — | — | — | — |
| Epsyn N557 | — | — | — | — | 150 | — | — | — | — | 150 |
| Nordel 1070 | — | — | — | — | — | 100 | 100 | 100 | 100 | — |
| Stearic acid | — | — | 0.5 | 0.5 | 1 | 1 | 1 | 1 | 1 | 1 |
| ZnO | 5 | 5 | 5 | 5 | 5 | 5 | 5 | 5 | 5 | 5 |
| Polymerized 2,2,4-trimethyl-1,2-dihydroquinoline | — | — | 1.5 | 1.5 | 1.5 | 1.5 | 1.5 | 1.5 | 1.5 | 1.5 |
| Sunpar 2280 oil | — | — | — | — | — | 5 | 5 | 5 | 5 | — |
| SRF-LM-NS(N762 black) | — | — | — | — | — | — | — | — | — | 100 |
| SRF-HM(N770 black) | 10 | 20 | — | — | 100 | — | — | — | — | — |
| HAF (N330 black) | — | — | 40 | 30 | — | 50 | 40 | 30 | 20 | — |
| N—1,3-dimethylbutyl-N'—phenyl-ρ-phenylenediamine | 3 | 3 | — | — | — | — | — | — | — | — |
| Sulfur | 0.6 | 0.6 | 1 | 1 | 1 | 1.5 | 1.5 | 1.5 | 1.5 | 1.5 |
| TMTM | 1 | 1 | 1 | 1 | 1.6 | 1.5 | 1.5 | 1.5 | 1.5 | 1.6 |
| Copper dimethyldithiocarbamate | — | — | — | — | 0.8 | — | — | — | — | 0.8 |
| MBT | 2 | 2 | 0.5 | 0.5 | 0.5 | 0.5 | 0.5 | 0.5 | 0.5 | 0.5 |
| Cure Conditions, Time (min.)/Temp. (°C.) | 30/160 | 30/160 | 20/160 | 20/160 | 20/160 | 60/160 | 69/160 | 60/160 | 60/160 | 30/160 |
| Tensile strength, MPa | 2.6 | 6.9 | 17.7 | 13.8 | 12.4 | 16.0 | 18.4 | 13.4 | 14.1 | 10.7 |
| % Elongation | 625 | 800 | 390 | 440 | 365 | 455 | 465 | 550 | 540 | 230 |
| Hardness, Shore A | 46 | 49 | 74 | 70 | 64 | 60 | 65 | 55 | 55 | 72 |
| % Relative Creep | 72.4 | 89.3 | 97.8 | 91.2 | 43.2 | 56.1 | 81.2 | 42.5 | 68.5 | 33.2 |
| Time on Test, days | 244 | 244 | 22 | 22 | 484 | 506 | 506 | 506 | 506 | 435 |

[a]Bloom badly.

| | 74 | 75 | 76 | 77 | 78 | 79 | 80 | 81 | 82 |
|---|---|---|---|---|---|---|---|---|---|
| Royalene 301T | 65 | 65 | 65 | 65 | — | — | — | — | — |
| Royalene 400 | 70 | 70 | 70 | 70 | — | — | — | — | — |
| Nordel 1070 | — | — | — | — | 100 | 100 | 100 | — | — |
| Vistalon 4608 | — | — | — | — | — | — | — | 100 | 100 |
| Stearic acid | — | — | — | — | 1 | 1 | 1 | 1 | 1 |
| Polymerized 2,2,4-trimethyl-1,2-dihydroquinoline | 0.5 | 0.5 | 0.5 | 0.5 | — | — | — | — | — |
| ZnO | 5 | 5 | 5 | 5 | 5 | 5 | 5 | 5 | 5 |
| SAF (N110 black) | 65 | 50 | 40 | 30 | — | — | — | — | — |
| HAF (N330 black) | — | — | — | — | 50 | 40 | 30 | 50 | 50 |
| MT (N900 black) | — | — | — | — | — | — | — | 50 | — |
| SRF-HM(N770 black) | — | — | — | — | — | — | — | 50 | 50 |
| Ethylene glycol dimethacrylate | 1 | 1 | 1 | 1 | — | — | — | — | — |
| Sulfur | — | — | — | — | 1.5 | 1.5 | 1.5 | 4 | 4 |
| TMTM | — | — | — | — | 1.5 | 1.5 | 1.5 | — | — |
| MBT | — | — | — | — | 0.5 | 0.5 | 0.5 | 2 | 2 |
| Flexon 480 oil | — | — | — | — | — | — | — | 40 | 20 |
| Vulcup 40 KE | 7.5 | 7.5 | 7.5 | 7.5 | — | — | — | — | — |
| TDEDC | — | — | — | — | — | — | — | 2.5 | 2.5 |
| Cure conditions, Time (min.)/Temp. (°C.) | 20/171 | 20/171 | 20/171 | 20/171 | 60/160 | 60/160 | 60/160 | 60/132 | 60/132 |
| Tensile strength, MPa | 17.8 | 17.2 | 11.3 | 10.0 | 18.6 | 19.6 | 15.5 | 11.3 | 13.3 |
| % Elongation | 455 | 460 | 450 | 465 | 415 | 505 | 500 | 190 | 235 |
| Hardness, Shore A | 61 | 54 | 50 | 47 | 68 | 60 | 56 | 80 | 82 |
| % Relative Creep | 59.1 | 164.1 | 49.7 | 72.6 | 65.1 | 53.6 | 42.9 | 49.6 | 46.3 |
| Time on Test, days | <5 | <5 | <5 | 6 | 42 | 42 | 42 | 37 | 37 |

While the present invention has been described in connection with a rather specific preferred embodiment thereof, it will be understood that many modifications and variations will be readily apparent to those of ordinary skill in the art and that this application is intended to cover any adaptation or variations thereof. Therefore, it is manifestly intended that this invention be only limited by the claims and the equivalents thereof.

What is claimed is:

1. A shock absorbing missile launch pad assembly for a MX type missile located within a launch canister, said launch assembly comprising:

a resilient pad configured to conform to the external surface of said missile;

a low coefficient of friction laminate bonded to the outer surface of said resilient pad for providing a substantially frictionless sliding surface adjacent the inner surface of said launch canister;

a support plate bonded to the inner surface of said resilient pad, said support plate being positionable against said external surface of said missile, said resilient pad extending over all boarders of said support plate to create bumper areas; and at least one recess defined within said support plate for receipt of a spring, a spring positioned within said recess, said spring operable to urge said launch pad assembly away from said external surface of said missile upon launch of said missile form said canister.

2. The pad assembly of claim 1, wherein said support plate comprises a fiberglass reinforced plastic plate.

3. The pad assembly of claim 1, wherein said resilient pad defines a plurality of cavities therein.

4. The pad assembly of claim 3, wherein said cavities comprise longitudinal and latitudinal cavities.

5. The pad assembly of claim 4, wherein said cavities comprise a NS12 design configuration.

6. A shock absorbing missile launch pad assembly as defined in claim 8 wherein said resilient pad comprises:

| | |
|---|---|
| VISTALON 2504 | 100.0 phr; |
| N762 Carbon Black | 40.0; and |
| DiCup 40KE | 7.5. |

7. A shock absorbing missile launch pad assembly as defined in claim 1, wherein said launch pad assembly further comprises means for releasably securing said launch pad assembly to said missile.

8. A shock absorbing missile launch pad assembly as defined in claim 4, wherein said resilient pad comprises:

| | |
|---|---|
| VISTALON 2504 | 100.0 phr; |
| N762 Carbon Black | 40.0; and |
| DiCup 40KE | 7.5. |

9. A shock absorbing missile launch pad assembly as defined in claim 8, wherein said launch pad assembly further comprises means for releasably securing said launch pad assembly to said missile.

10. A shock absorbing missile launch pad assembly as defined in claim 1 wherein said low coefficient of friction laminate is a Teflon-fiberglass laminate.

11. A shock absorbing missile launch pad assembly as defined in claim 10 wherein said resilient pad comprises:

| | |
|---|---|
| VISTALON 2504 | 100.0 phr; |
| N762 Carbon Black | 40.0; and |
| DiCup 40KE | 7.5.-- |

* * * * *